US005896841A

United States Patent [19]

Nemoto et al.

[11] Patent Number: 5,896,841

[45] Date of Patent: Apr. 27, 1999

[54] ELECTRONICALLY CONTROLLED HYDRAULIC ACTUATION TYPE FUEL INJECTION DEVICE UTILIZING OIL VISCOSITY DETECTION DEVICE AND METHOD

[75] Inventors: Hideki Nemoto; Tadashi Uchiyama; Tomoaki Kakihara, all of Fujisawa, Japan

[73] Assignee: Isuzu Motors Limited, Tokyo, Japan

[21] Appl. No.: 08/931,320

[22] Filed: Sep. 16, 1997

[30] Foreign Application Priority Data

Sep. 19, 1996 [JP] Japan ..... 8-248191

[51] Int. Cl.[6] ..... F02M 37/04

[52] U.S. Cl. ..... 123/381; 123/494; 123/456; 137/92

[58] Field of Search ..... 123/446, 456, 123/381, 447, 500, 501, 494, 497; 137/92

[56] References Cited

U.S. PATENT DOCUMENTS

| | | | |
|---|---|---|---|
| 2,478,521 | 8/1949 | Booth | 137/92 |
| 2,602,461 | 7/1952 | Walker | 137/92 |
| 2,621,672 | 12/1952 | Jacobs | 137/92 |
| 3,204,623 | 9/1965 | Isley | 123/381 |
| 3,275,018 | 9/1966 | Roberts | 137/92 |
| 3,277,916 | 10/1966 | Deming | 137/92 |
| 4,971,005 | 11/1990 | Dyer | 123/381 |
| 5,024,200 | 6/1991 | Free | 123/381 |
| 5,181,494 | 1/1993 | Ausman | 123/381 |
| 5,357,912 | 10/1994 | Barnes | 123/381 |
| 5,586,538 | 12/1996 | Barnes | 123/381 |

*Primary Examiner*—Carl S. Miller

*Attorney, Agent, or Firm*—Rader, Fishman & Grauer PLLC

[57] ABSTRACT

In an electronically controlled hydraulic actuation type fuel injection device, a viscosity value (mu) of hydraulic oil is detected by an oil viscosity detection sensor and then an aimed base valve opening time $T_{injBASE}$ during which a solenoid valve of a unit injector to be kept open is corrected based on the detected viscosity value. Lubricating oil for lubricating an engine is used as the hydraulic oil. The oil viscosity detection sensor includes an oil pump for supplying the lubricating oil to each sliding part of the engine and an oil sensor for detecting a delivery pressure Po of the oil pump. All of the sliding parts of the engine is regarded as one "throttle" and the viscosity (mu) of the hydraulic oil is determined according to a pre-prepared map from the engine speed Ne and the delivery pressure Po, utilizing change in passage resistance at the "throttle" caused by oil viscosity change. This oil viscosity detection device and the oil viscosity detection method utilizing that device can be easily added to every conventional engine as an option.

2 Claims, 5 Drawing Sheets

ELECTRONICALLY CONTROLLED HYDRAULIC ACTUATION TYPE FUEL INJECTION DEVICE UTILIZING OIL VISCOSITY DETECTION DEVICE AND METHOD

BACKGROUND OF THE INVENTION

1. Technical Field

The present invention relates to an electronically controlled hydraulic actuation type fuel injection device adapted to be used in a diesel engine and an oil viscosity detection device and method utilized in the fuel injection device.

2. Background Art

Conventionally, an electronically controlled hydraulic actuation type fuel injection device as described in WO 93/07381 has been known as a typical fuel injection device adapted for use in a diesel engine. In such a device, relatively high pressure hydraulic oil is supplied to each unit injector for operating a pressure intensifying piston inside the unit injector with the working hydraulic pressure such that the pressure intensifying piston pressurizes relatively low pressure fuel reservoired inside the unit injector to the injection pressure and the pressurized fuel lifts up a needle valve for carrying out fuel injection. It should be noted that lubricating oil for lubricating the engine is used as the hydraulic oil in such devices as above.

Hydraulic pressure supplied to the pressure intensifying piston is controlled by opening/closing a solenoid valve integrated into the unit injector by way of a controller such as ECU. Signals indicative of engine speed, accelerator opening, crank angle etc. are input in the controller. The controller determines valve opening time during which the solenoid valve to be kept open based on the engine speed and the accelerator opening data, utilizing a pre-memorized map. The controller then sets the solenoid valve in on-state only during the determined (valve opening) time, allowing an adequate hydraulic pressure to be supplied to the pressure increasing piston to carry out fuel injection of a level that is appropriate for the current operational state of the engine. The controller also controls the oil manifold internal pressure as pressure reservoir in accordance with the operational state of the engine such that the working hydraulic pressure supplied to the solenoid valve can be controlled.

In the conventional fuel injector of the structure described above, the amount of fuel injection is determined according to the time during which the solenoid valve to be kept open. However, this system has a defect that the amount of fuel injection per time (time during which the solenoid valve is kept open) may vary in accordance with the change in viscosity of the working hydraulic oil. Hydraulic oil (lubricating oil for the engine is used as hydraulic oil) inevitably experiences change in its viscosity according to the use grade, temperature, deterioration state and the like. Since resistance the hydraulic oil experiences as it passes through the solenoid valve varies according to such change in viscosity, the flow amount of the hydraulic oil per time (time during which the solenoid valve is kept open) also varies. If the flow amount of the hydraulic oil per time changes, the operational state of the pressure intensifying piston and the needle valve cannot be kept constant, resulting in variation of the amount of fuel injection. The variation of injected fuel amount may cause lower engine power, increased emission of harmful products such as smoke in the exhaust gas.

SUMMARY OF THE INVENTION

An electronically controlled hydraulic actuation type fuel injection device according to the present invention has a pressure intensifying piston operated by a hydraulic pressure of a hydraulic oil. The hydraulic pressure is controlled by opening/closing of a solenoid valve. This fuel injection device includes a unit injector for pressurizing fuel with the pressure intensifying piston such that its needle valve can be lifted up, oil viscosity detection means for detecting viscosity of the hydraulic oil, and a controller for determining valve opening time during which the solenoid valve to be kept open according to an operational state of an engine and for correcting the valve opening time based on a viscosity value detected by the oil viscosity detection means.

According to the structure described above, valve opening time during which the solenoid valve to be kept open is corrected based on a viscosity value detected by the oil viscosity detection means. As a result, the optimum valve opening time can be determined according to the viscosity of the hydraulic oil and thus the amount of fuel injection can always be kept constant regardless of change in oil viscosity, curbing variation of fuel injection amount to the minimum level.

The electronically controlled hydraulic actuation type fuel injection device of the present invention further includes first pump means for pressurizing the hydraulic oil and supplying the pressurized hydraulic oil to the solenoid valve. The lubricating oil for the engine is used as the hydraulic oil. The oil viscosity detection means preferably includes second pump means driven by the engine for supplying the lubricating oil to each sliding part of the engine, and an oil pressure sensor for detecting delivery pressure of the second pump means. This structure allows detecting viscosity of lubricating oil or hydraulic oil by a detection device with much simpler design than in the prior art.

In addition, the present invention provides an oil viscosity detection device that includes pump means driven by an engine for supplying a lubricating oil to each sliding part of the engine, an oil pressure sensor for detecting delivery pressure of the pump means, and a controller for determining viscosity of the lubricating oil based on a speed of the engine and a delivery pressure value detected by the oil pressure sensor. This oil viscosity detection device having a relatively simple structure enables determining viscosity of the lubricating oil with high precision.

Further, the present invention provides a method for detecting oil viscosity. This method includes the step of, when supplying a lubricating oil to each sliding part of an engine by a pump driven by the engine, regarding all of the sliding parts as a throttle, and the step of determining viscosity of the lubricating oil base on a speed of the engine and a delivery pressure of the pump on the upstream side of the throttle. Due to this method, determination of viscosity of lubrication oil with high precision can be performed with a relatively simple device.

DESCRIPTION OF THE PREFERRED EMBODIMENTS

Below, the preferred embodiment of the present invention will be described in details with reference to the accompanying drawings.

Figure 1:
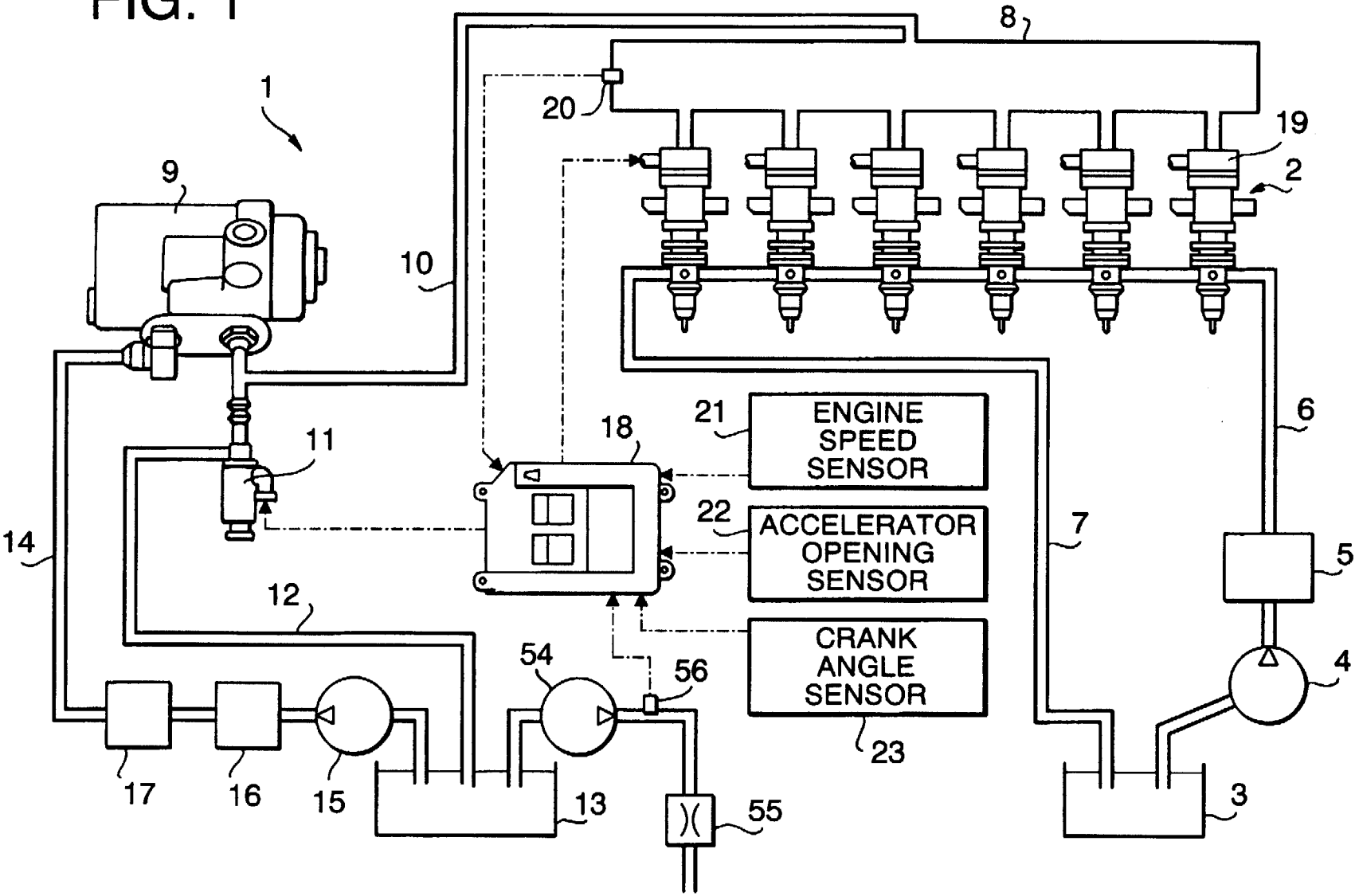
FIG. 1 shows a structure of an electronically controlled hydraulic actuation type fuel injection device provided in accordance with the present invention.

FIG. 1 shows a structure of an electronically controlled hydraulic actuation type fuel injection device provided in accordance with the present invention. As shown in the drawing, the electronically controlled hydraulic actuation type fuel injection device 1 is provided with a plurality of unit injector 2 of which number corresponds to the number of engine cylinders. Fuel in a fuel tank 3 is supplied toward the unit injector 2 by a fuel feed pump 4 through a fuel filter 5. The fuel is then sent to each unit injector 2 through a fuel supply path 6 and is eventually returned to the fuel tank 3 through a fuel return path 7. Since each unit injector 2 is mounted on each cylinder head (not shown in FIG. 1), the fuel supply path 6 and the fuel return path 7 are actually defined by a port formed inside the cylinder head and paths linking the port and the fuel tank.

Each unit injector 2 is also connected to an oil manifold 8 that accumulates hydraulic oil (that is, oil pressure) of a relatively high pressure (about 20–40 MPa) and distributes the hydraulic oil to each unit injector 2. In the present embodiment, lubricating oil for lubricating the engine is used as the hydraulic oil thus enabling a simpler structure and lower cost. However, a hydraulic oil may be exclusively prepared and used for unit injectors 2. A high pressure oil pump 9 (first pump means) driven by or associated with the engine delivers the highly pressurized hydraulic oil to the oil manifold 8 through a high pressure oil path 10. The pressure accumulated in the oil manifold 8 is controlled by a flow control valve 11. More specifically, the flow control valve 11 controls the delivery pressure from the high pressure oil pump 9 as well as the accumulated pressure or internal pressure in the manifold 8 by returning a portion of the hydraulic oil delivered from the high pressure oil pump 9 to an oil tank 13 (an oil pan) by way of an oil return path 12.

The hydraulic oil or lubricating oil in the oil tank 13 is sent to the inlet side of the high pressure oil pump 9 through a low pressure path 14. A oil feed pump 15 driven by or associated with the engine is provided on the low pressure path 14 and the oil feed pump 15 pumps up the hydraulic oil in the oil tank 13, pressurizes the oil to an appropriate level and delivers the pressurized oil to the high pressure oil pump 9. It should be noted that the oil feed pump 15 may be omitted if the high pressure oil pump 9 is capable enough of doing all the pumping by itself. The low pressure oil path 14 has an oil filter 16 and an oil cooler 17 provided sequentially on the delivery side of the oil feed pump 15.

Again referring to FIG. 1, a controller 18 including CPU or ECU is shown. The controller 18 is electrically connected to a solenoid valve 19 of each unit injector 2, a manifold pressure sensor 20 of the oil manifold 8, and the flow control valve 11. The controller 18 is also electrically connected to an engine speed sensor 21 for detecting engine speed (rotation per time), an accelerator opening sensor 22 for detecting accelerator opening, and a crank angle sensor 23 for detecting crank angle of the engine (not shown). Similarly, a temperature sensor for cooling water, an inlet tube internal pressure sensor, an atmospheric pressure sensor and a fuel temperature sensor and the like (not shown) are connected to the controller 18. The amount of fuel injection is determined based on the output of these sensors.

Figure 2:
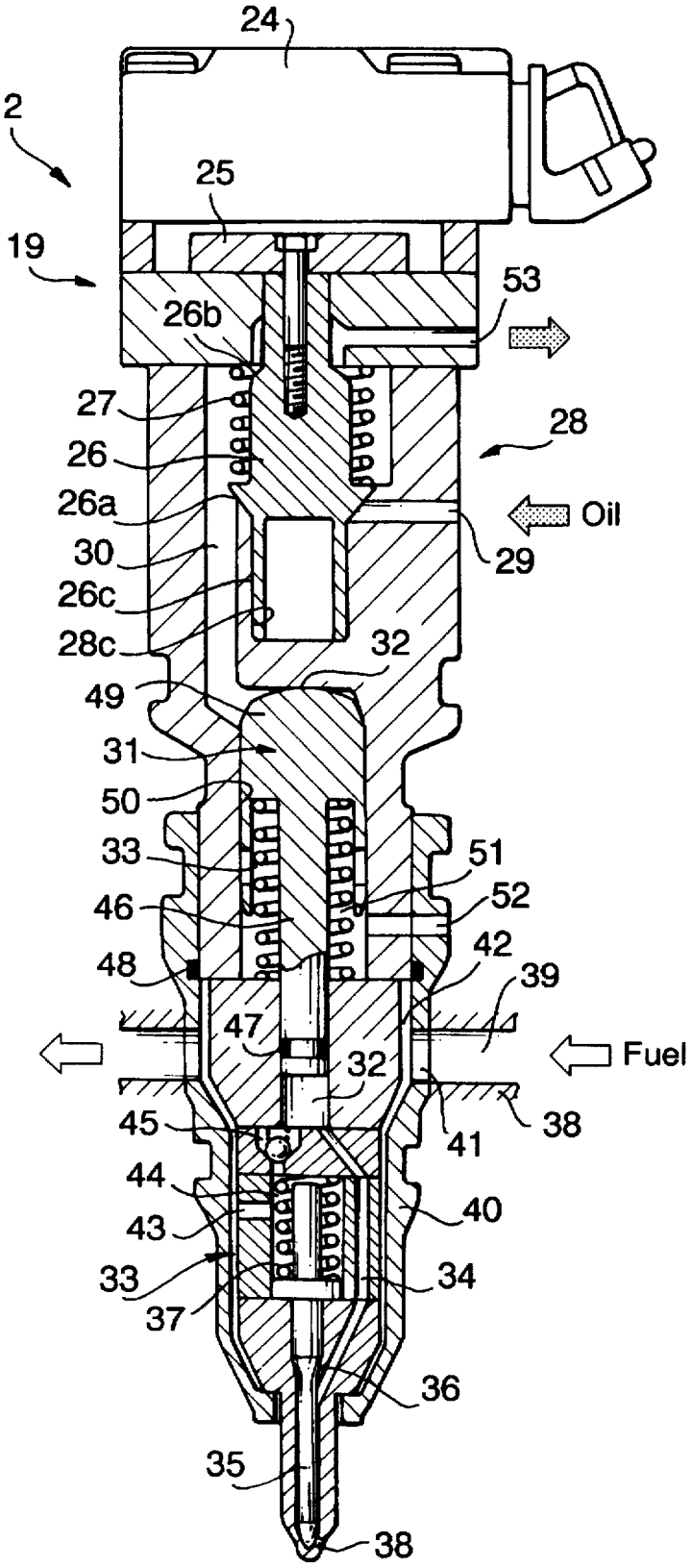
FIG. 2 is a vertically sectional view of a unit injector.

Next, FIG. 2 shows the detailed structure of the unit injector 2. As shown in the drawing, each unit injector 2 incorporates a solenoid valve 19 in its upper portion. The solenoid valve 19 includes electromagnetic solenoid 24, an amateur 25, a valve member 26 and a valve return spring 27. The electromagnetic solenoid 24 shown in FIG. 2 is in its unactuated state in which it 24 is not excited. The highly pressurized (high pressure) hydraulic oil from the oil manifold 8 is constantly supplied to an oil supply passage 29 formed in the injector body 28. It should be noted that in FIG. 2 the valve member 26 biased by the valve return spring 27 is closing the outlet of the oil supply passage 29, thus blocking the high pressure hydraulic oil.

When the electromagnetic solenoid 24 is excited by a valve opening signal (ON signal) from the controller 18, the amateur 25 and the valve member 26 are associatedly lifted up against the biasing force of the valve return spring 27. As a result, the outlet of the oil supply passage 29 is opened and the high pressure hydraulic oil enters a hydraulic oil chamber 30. This hydraulic oil or hydraulic pressure works on the hydraulic working surface 32 formed at the top surface of a pressure intensifying piston 31, pushing down the pressure intensifying piston 31 against the biasing force of a piston return spring 33.

The pressure intensifying piston 31 compresses and pressurizes the low pressure fuel being reservoired in the fuel reservoir chamber 32. The pressurized fuel then works on a taper portion 36 of a needle valve 35 by way of a high pressure fuel port 34 formed in a nozzle body 33 and its fuel pressure lifts up the needle valve 35 against the biasing force of a nozzle return spring 37. Accordingly, fuel having a predetermined injection pressure is injected from an injection hole 38 at the tip of the nozzle body 33 into the cylinder by way of a clearance around the needle valve 35.

The fuel supply to the fuel reservoir chamber 32 is performed as described below. The unit injector 2 is mounted on a cylinder head 38. A fuel port 39 is formed inside the cylinder head 38. The fuel port 39 is in fluid communication with the fuel inlet 41 of a retaining nut 40, thus the fuel can flow into the unit injector 2. The fuel is reservoired in a clearance 42 formed between the retaining nut 40 and the nozzle body 33 and this fuel passes through a fuel introduction port 43 and a spring chamber 44 formed inside the nozzle body 33, and then a check valve 45, before eventually entering the fuel reservoir chamber 32.

When the fuel is pressurized in the fuel reservoir chamber 32, the check valve 45 is closed by the fuel pressure and thus the pressurized fuel is sent to the taper portion 36 of the needle valve 35 only through the high pressure fuel port 34. On the other hand, when the injection is completed and the pressure intensifying piston 31 is lifted up, the check valve 45 is opened due to the decreased pressure in the fuel reservoir chamber 32, allowing the low pressure fuel in the spring chamber 44 to be supplied to the fuel reservoir chamber 32.

At this stage, the lower end of the shaft 46 of the pressure intensifying piston 31 is slidably inserted into the fuel reservoir chamber 32 and an O ring 47 provided at the insertion section seals the fuel. In addition, an O ring 48 is provided on the retaining nut 40 at the interface of the nozzle body 33 and the injector body 28, preventing fuel leakage from the clearance 42. The cup shaped-head 49 of the pressure intensifying piston 31 is slidably inserted into a cylinder bore 50.

A space defined under the head 49 in the cylinder bore 50 that accommodates the piston return spring 33 is an air chamber 51. The air chamber 51 is in fluid communication with the outside of the unit injector 2 (or a space above the cylinder head 38 inside the cylinder head cover) through a bypass bore 52. Accordingly, if the hydraulic oil leaks, the leaking hydraulic oil can be collected in the air chamber 51 and discharged into the space above the cylinder head 38 inside the cylinder head cover. The discharged hydraulic oil is immediately utilized as lubricating oil for cams, journals and the like.

On the other hand, the hydraulic oil chamber 30 is in fluid communication with the inside of the cylinder head 38 through a oil discharge passage 53 formed in the upper portion of the injector body 28. When the solenoid valve 19 is turned on, the valve member 26 is lifted up to the dead end and the inlet of the oil discharge passage 53 is closed. Then, when the solenoid valve 19 is turned off, the inlet of the oil discharge passage 53 is made open and the high pressure oil in the hydraulic chamber 30 is discharged through the oil discharge passage 53, thus completing fuel injection. The discharged hydraulic oil, which is lubricating oil as described above, is utilized for lubricating cams, journals and the like.

As shown in the drawing, the valve member 26 is designed like a poppet valve of which lower taper part **26*a* closes the outlet of the oil supply passage 29 and of which upper taper part 26*b* closes the inlet of the oil discharge passage 53. A guide shaft 26*c* being the lower end of the valve member 26 is slidably inserted into the bore 28*c* of the injector body 28 such that the valve member 26** is guided during its up/down motion.

One characteristic of the structure according to the present invention is providing oil viscosity detection means for detecting viscosity of the hydraulic oil (the lubricating oil). As shown in FIG. 1, the device 1 is provided with an oil pump 54 (second pump means) for lubricating the engine, as well as the aforementioned oil feed pump 15 and the high pressure oil pump 9. The oil pump 54, as is in other engine systems, driven by or associated with the engine, supplies to each of the sliding parts such as camshafts, crank shafts and gear trains of the engine an appropriate amount of the lubricating oil in the oil tank 13 according to the engine speed. In FIG. 1, those sliding parts as above mentioned are all together symbolically regarded and represented as a throttle 55.

Further, an oil pressure sensor 56 for detecting the delivery pressure of the oil pump 54 is provided on the upstream side of the throttle 55 and the detection signals from the oil pressure sensor 56 is transmitted to the controller 18.

Next, the method for controlling the electronically controlled hydraulic actuation type fuel injection device 1 by the controller 18 will be described according to a control flowchart shown in FIG. 3.

During the operation of the engine, the crank angle sensor 23 constantly outputs pulse signals indicative of the crank angle of the engine. The controller 18 begins to count time from the moment of inputting a predetermined standard pulse (step 1) till fuel injection time T with a clock contained in it 18. In addition, control for determining the aimed injection time (the aimed valve opening time) $T_{inj}$ is also started at the moment of inputting a predetermined standard pulse. The crank angle sensor 23 may be located near to the drive shaft of the high pressure oil pump 9 such that the standard pulse is generated at the upper dead point of each cylinder.

Then, at step 2, the engine speed Ne, the accelerator opening Acc, the internal pressure Pm of the oil manifold 8 (the manifold pressure), and the delivery pressure Po of the oil pump 54 are read from each detection signal of the engine speed sensor 21, the accelerator opening sensor 22, the manifold pressure sensor 20 and the oil pressure sensor 56, respectively.

At step 3, the aimed base fuel injection amount $Q_{BASE}$ and the aimed injection time Tt are determined according to the map pre-memorized in the ROM, mainly based on the engine speed Ne and the accelerator opening Acc read in step 2. As a result, the basic fuel injection amount based on the current operation state of the engine can be determined. Further, though not shown in FIG. 3, an aimed manifold pressure PmO is calculated based on the engine speed Ne and the accelerator opening Acc and the flow control valve 11 is subject to duty control according to the discrepancy between the aimed manifold pressure PmO and the actual manifold pressure Pm such that those two manifold pressures can be equal. The aimed manifold pressure PmO is set such that it becomes low in a low speed/decreased load condition when the accelerator opening is relatively small and it becomes high in a high speed/increased load condition when the accelerator opening is relatively large.

Figure 4:
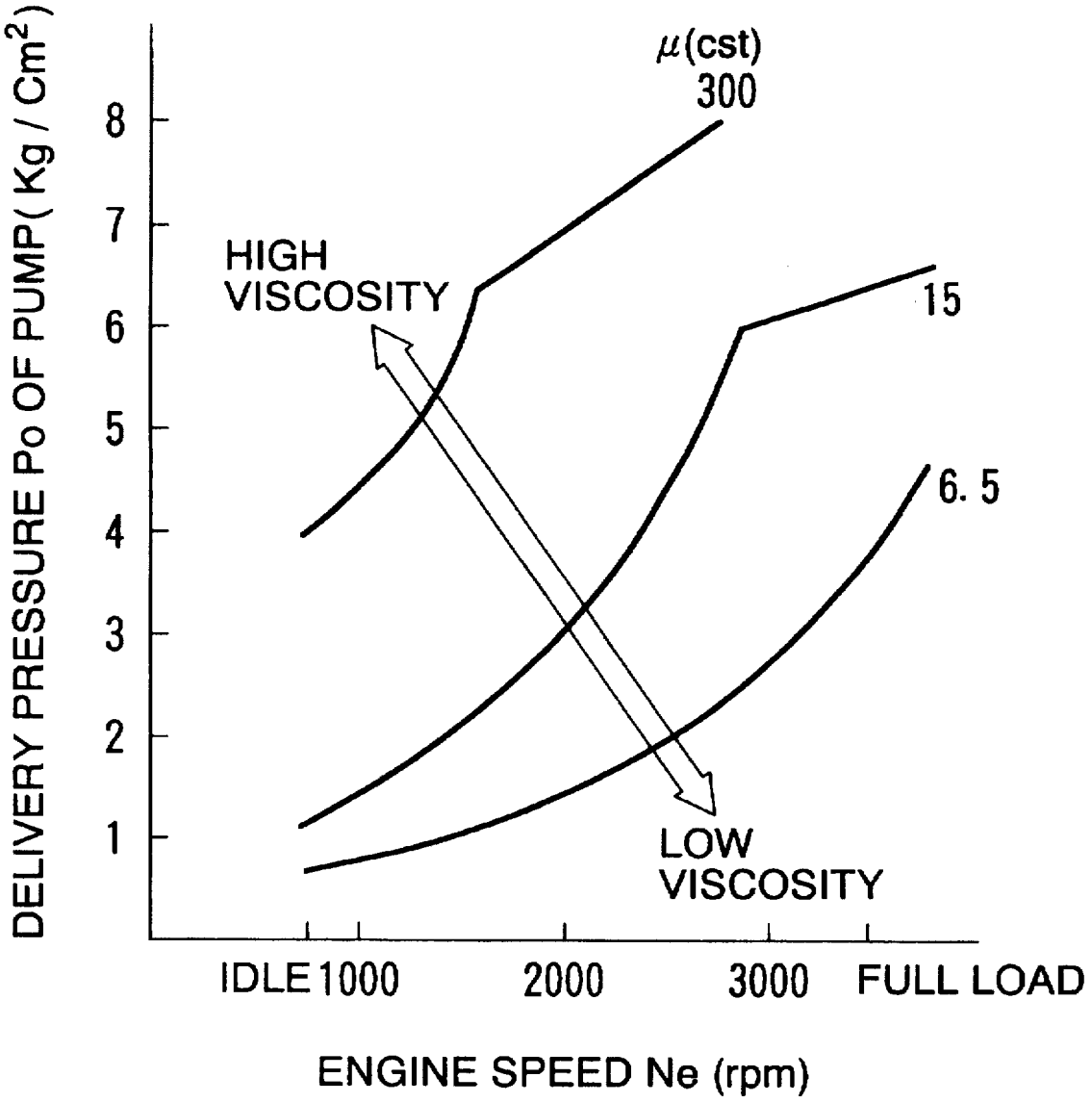
FIG. 4 is a graph showing an oil viscosity map.
Figure 5:
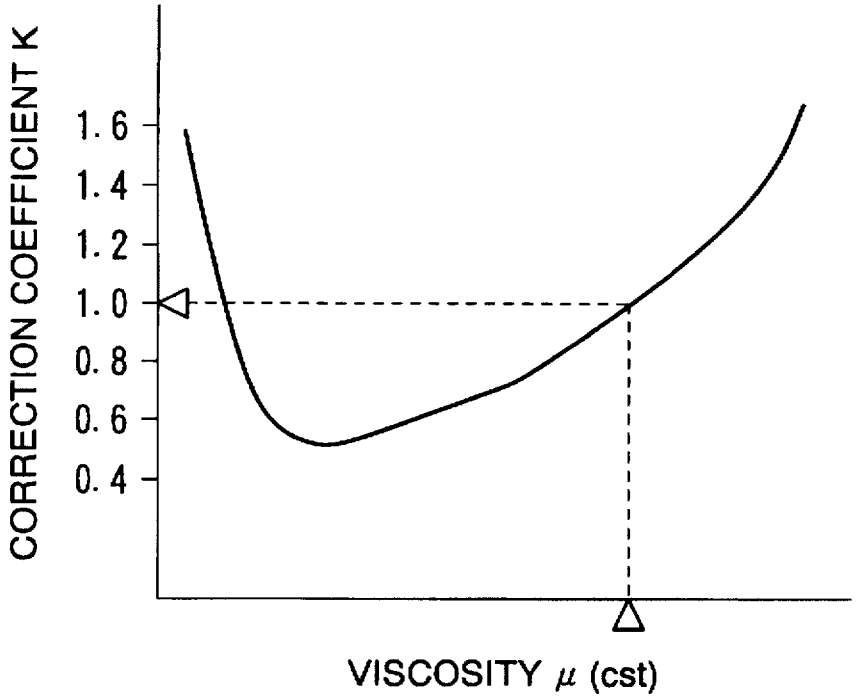
FIG. 5 is a correction coefficient table.

Next, at step 4, oil viscosity (mu factor) is determined based on the engine speed Ne and the pump delivery pressure Po read at step 2 utilizing the oil viscosity map shown in FIG. 4, and then a correction coefficient K is determined based on this oil viscosity (mu) in accordance with the correction coefficient table shown in FIG. 5. The necessary maps and tables as described above are all pre-memorized in the ROM of the controller 18.

The oil viscosity map shown in FIG. 4 represents an empirically confirmed relationship between the engine speed Ne (scaled on the X axis) and the pump delivery pressure Po (scaled on the Y axis) under various conditions of hydraulic oil viscosity (mu). The graph shows three viscosity curves when the mu value is 6.5, 15, 300(cst) each, but other viscosity curves under other mu values could be represented as well. The larger the mu value becomes, the curves tend to be spread with less space between each.

Herein, since each sliding part of the engine experiences a substantially constant resistance, all the sliding parts can symbolically be represented by a single throttle or a fixed orifice 55. On the other hand, the oil pump 54 is associatedly driven by the engine and thus increases its delivery flow amount and delivery pressure as the engine speed increases. However, even if the engine speed is kept constant, the delivery pressure from oil pump 54 may vary since different oil viscosity (mu) results in different flow resistance at the throttle 55. Accordingly, if a map representing the relationship between the engine speed Ne, the pump delivery pressure Po and the oil viscosity (mu) has been prepared in advance, the value of oil viscosity (mu) can be reliably determined from the engine speed Ne and the pump delivery pressure Po. The pump delivery pressure Po has a characteristic of increasing in proportion to the square of the engine speed Ne due to its passing through the throttle 55. The proportional coefficient in this case varies according to the oil viscosity (mu).

FIG. 5 shows the correction coefficient map that represents the relationship between the oil viscosity mu (scaled on the X axis) and the correction coefficient K (scaled on the Y axis) and thus allows the K value to be determined based on the mu value obtained as described above.

Figure 6:
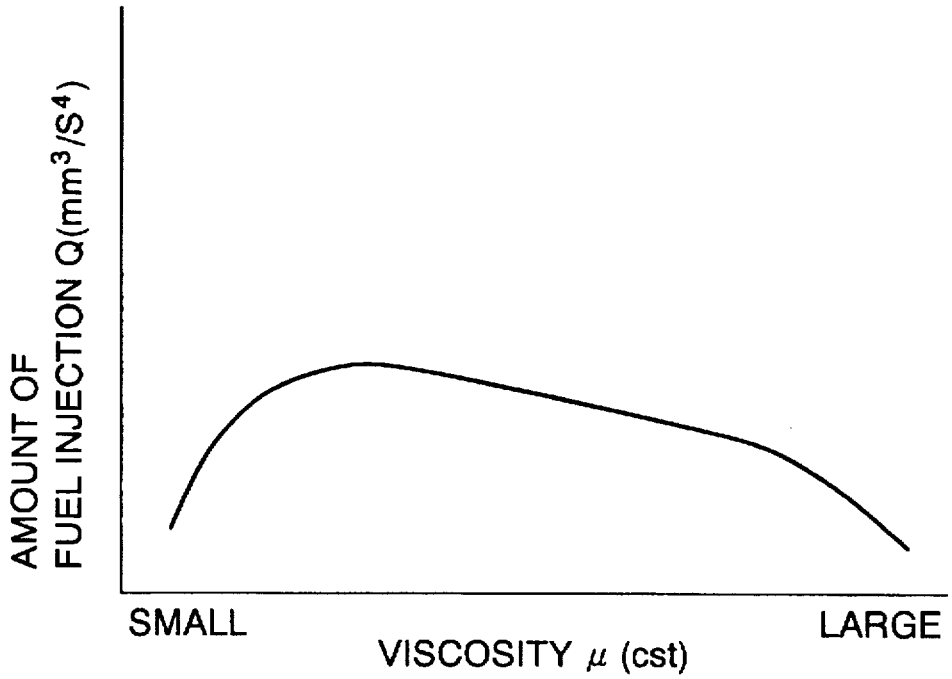
FIG. 6 is a graph showing the relationship between oil viscosity and amount of fuel injection.

As aforementioned, the conventional device experiences the variation in fuel injection amount due to the change in viscosity of the hydraulic oil (shown in FIG. 6). In this graph shown in FIG. 6, pressure of the hydraulic oil (manifold pressure Pm) and time during which the solenoid valve 19 is kept open (fuel injection time $T_{inj}$) remain constant.

As shown in FIG. 6, fuel injection amount Q tends to decrease as viscosity mu of the hydraulic oil increases. The reason for this will be described hereinafter. Referring to FIG. 2, when the solenoid valve 19 is opened and the valve member 26 is lifted up, an outlet of the oil supply passage 29 is formed that also functions as a throttle. Due to the passage resistance this throttle causes, the larger the viscosity is (the "harder" the hydraulic oil is), the slower the entrance of the hydraulic oil becomes, bringing fewer strokes of the pressure intensifying piston 31 and thus reducing the fuel injection amount Q.

In addition, FIG. 6 shows a significant decrease in the fuel injection amount Q when the viscosity (mu) of the hydraulic oil is extremely small. The reason for this decrease will be described below. Referring to FIG. 2, when the solenoid valve 19 changes its state from closed to open, the valve member 26 sitting next to the outlet of the oil supply passage 29 is raised until it 26 blocks the inlet of the oil discharge passage 53. During this uplifting movement, a state in which the valve member 26 keeps both the outlet of the oil supply passage 29 and the inlet of the oil discharge passage 53 open occurs. At such a state of the valve member 26, if the viscosity mu is extremely small (or if the hydraulic oil is extremely "soft"), the hydraulic oil entering from the oil supply passage 29 immediately flows into the oil discharge passage 53, causing a significant decrease in the fuel injection amount Q.

In the injection device 1 of the present invention, a correction coefficient K properly corresponding to the oil viscosity (mu) is determined according to the correction coefficient table showing FIG. 5 such that change in viscosity of the hydraulic oil does not affect the fuel injection amount Q. It should be noted that the curve shown in the map of FIG. 5 is in a reverse relationship with the curve shown in FIG. 6.

Figure 3:
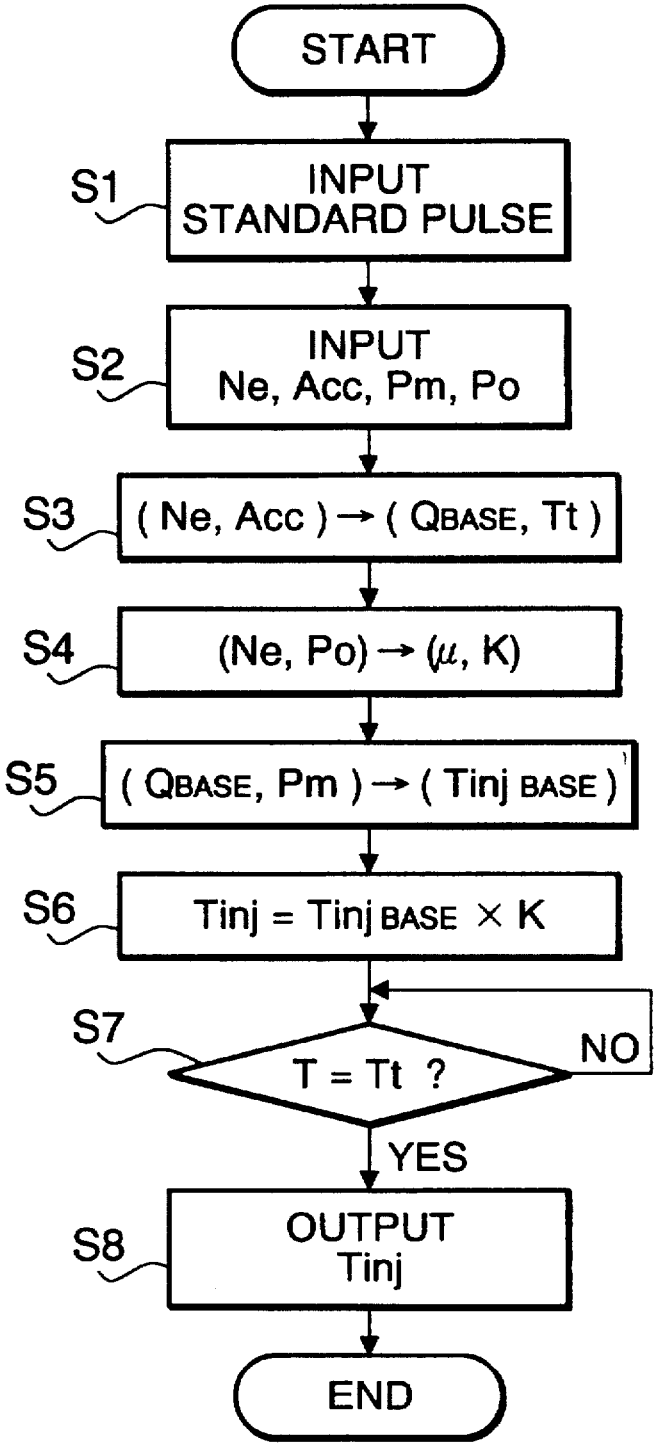
FIG. 3 is a control flow chart of the electronically control led hydraulic actuation type fuel injection device provided in accordance with the present invention.

After determining the correction coefficient K, an aimed base valve opening time $T_{injBASE}$ during which the solenoid valve 19 is kept open (time during which the electromagnetic solenoid 24 is excited) is calculated or determined from the map at step 5 shown in FIG. 3, based on the aimed base injection amount $Q_{BASE}$ and the manifold pressure Pm obtained at step 3 (S3).

Next, at step 6, the aimed base valve opening time $T_{injBASE}$ is multiplied by the $T_{inj}$ that has been determined in consideration of the change in oil viscosity.

At step 7, whether the current time T corresponds with the fuel injection time Tt or not is determined. If the time T corresponds with the fuel injection time Tt (that is, the fuel injection time Tt arrives), the operation proceeds to step 8 and the solenoid valve 19 is turned ON (made open) during the aimed valve opening time $T_{inj}$. Accordingly, fuel injection of the optimum fuel amount, of the optimum pressure, and of the optimum injection timing that has taken the change in viscosity of the hydraulic oil into account can be performed.

Therefore, if the lubricating oil being used is subject to change in its viscosity due to grade difference, temperature change, deteriorated quality and the like, fuel injection of a constant amount of fuel can always be achieved, thus curbing the variation in fuel injection amount at the minimum level. In addition, decrease in the engine power and increase in the harmful compounds in the exhaust gas that would occur with the variation of the fuel injection amount can be prevented.

Further, as an especially unique aspect of the injection device 1, the hydraulic system for operating the unit injector 2 (including the high oil pressure pump 9) and the lubricating system for lubricating the engine (including the oil pump 54) are separated but utilize the same lubricating oil in common. In detection of oil viscosity, the sliding parts of the engine are regarded all together as one "throttle" and the oil viscosity (mu) is determined from the inlet pressure of the "throttle" (the pump delivery pressure Po) and the engine speed (rotation per time) Ne. As a result, a single hydraulic pressure sensor 56 added to the normal lubrication system is enough for highly precise detection of oil viscosity (mu), allowing a simpler design and thus lower cost.

Further, since other engines having a normal (conventional) fuel injection device are always provided with separate lubricating system including an oil pump, the oil viscosity detection device and method as described above can be applied to virtually all engines without complications. In addition, this oil viscosity detection device and method can be utilized not only for the correction control on fuel injection amount, but also for warning oil deterioration (that is, warning the arrival of time to change oil to an operator of the engine). This device and method can be easily added to a conventional engine as an option, which is a remarkable advantage.

By the way, the conventionally popular correction method on fuel injection amount is based on the detection of the hydraulic oil temperature. Friction in an engine varies according to change in oil viscosity caused by oil temperature change and this method simply increases/decreases the fuel injection amount such that the variation in friction (due to temperature change) can be corrected. However, this method cannot detect the precise oil viscosity, and the detection of oil grade difference and the deteriorated state of oil are out of question.

Also, a method for detecting oil viscosity by pressure difference of lubricating oil in the oil distribution system is disclosed in Japanese Patent Application 5-10866. However, this method has a significant defect of requiring two hydraulic pressure sensors in the oil distribution system, resulting in higher cost and more setting space.

Though the present invention has been described in accordance with its preferred embodiment, the invention is not limited to that but can be applied to any other embodiments, such as applications in which unit injectors have different structures.

What is claimed is:

1. An electronically controlled hydraulic actuation type fuel injection device comprising:

a unit injector having a pressure intensifying piston operated by the hydraulic pressure of a pressurized hydraulic oil, for pressurizing fuel with the pressure intensifying piston such that its needle valve can be lifted up, the hydraulic pressure being controlled by opening/closing of a solenoid valve;

oil viscosity detection means for detecting viscosity of the hydraulic oil; and a controller for determining valve opening time during which the solenoid valve is to be kept open according to an operational state of an engine and for correcting the valve opening time based on a viscosity value detected by the oil viscosity detection means;

a first pump means for pressurizing the hydraulic oil and supplying the pressurized hydraulic oil to the solenoid valve, the hydraulic oil being a lubricating oil for the engine, and wherein the oil viscosity detection means includes: second pump means driven by the engine for supplying the hydraulic oil to each sliding part of the engine for lubrication purposes: and an oil pressure sensor for detecting delivery pressure of the second pump means.

2. An oil viscosity detection device comprising:

pump means driven by an engine for supplying a hydraulic oil to each sliding part of the engine;

an oil pressure sensor for detecting delivery pressure of the pump means; and a controller for determining viscosity of the hydraulic oil based on a speed of the engine and a delivery pressure value detected by the oil pressure sensor, wherein the pump means includes a first pump means for pressurizing the hydraulic oil and supplying the pressurized hydraulic oil to the solenoid valve, the hydraulic oil being a lubricating oil for the engine, and wherein the controller includes an oil viscosity detection means which further includes a second pump means driven by the engine for supplying the hydraulic oil to each sliding part of the engine; and an oil pressure sensor for detecting delivery pressure of the second pump means.

* * * * *